US010475335B1

(12) United States Patent
Drinkwater et al.

(10) Patent No.: US 10,475,335 B1
(45) Date of Patent: Nov. 12, 2019

(54) SYSTEMS AND METHODS FOR VISUALIZING TELEMATICS DATA

(71) Applicant: STATE FARM MUTUAL AUTOMOBILE INSURANCE COMPANY, Bloomington, IL (US)

(72) Inventors: Lee Michael Drinkwater, Rochester, NY (US); Anuj Dahiya, Naperville, IL (US); Sahiti Kolli, Champaign, IL (US); Paul Chang Hoon Chae, Champaign, IL (US)

(73) Assignee: STATE FARM MUTUAL AUTOMOBILE INSURANCE COMPANY, Bloomington, IL (US)

( * ) Notice: Subject to any disclaimer, the term of this patent is extended or adjusted under 35 U.S.C. 154(b) by 0 days.

(21) Appl. No.: 15/826,986

(22) Filed: Nov. 30, 2017

(51) Int. Cl.

| | |
|---|---|
| ***G08G 1/01*** | (2006.01) |
| ***G08G 1/0969*** | (2006.01) |
| ***G08G 1/09*** | (2006.01) |
| *G08G 1/052* | (2006.01) |

(52) U.S. Cl.
CPC ..... *G08G 1/0125* (2013.01); *G08G 1/0112* (2013.01); *G08G 1/0141* (2013.01); *G08G 1/091* (2013.01); *G08G 1/0969* (2013.01); *G08G 1/0145* (2013.01); *G08G 1/052* (2013.01)

(58) Field of Classification Search
CPC .. G08G 1/0125; G08G 1/0112; G08G 1/0141; G08G 1/091; G08G 1/0969; G08G 1/0145; G08G 1/052
USPC ..... 701/117
See application file for complete search history.

(56) References Cited

U.S. PATENT DOCUMENTS

| | | | | |
|---|---|---|---|---|
| 9,177,427 | B1 * | 11/2015 | Briggs | G07C 5/00 |
| 9,805,521 | B1 * | 10/2017 | Davidson | G07C 5/02 |
| 9,805,601 | B1 * | 10/2017 | Fields | G08G 1/096791 |
| 9,846,979 | B1 * | 12/2017 | Sainaney | G07C 5/002 |
| 9,919,648 | B1 * | 3/2018 | Pedersen | G08G 1/0116 |
| 10,032,318 | B1 * | 7/2018 | Ferguson | G07C 5/008 |
| 2011/0260884 | A1 * | 10/2011 | Yi | G07C 5/008 340/870.02 |
| 2013/0304349 | A1 * | 11/2013 | Davidson | G08G 1/0112 701/99 |
| 2014/0052689 | A1 * | 2/2014 | Ficara | G06F 16/178 707/610 |
| 2015/0187016 | A1 * | 7/2015 | Adams | G06Q 40/08 705/4 |

(Continued)

*Primary Examiner* — Marthe Y Marc-Coleman
(74) *Attorney, Agent, or Firm* — Marshall, Gerstein & Borun LLP; Randall G. Rueth

(57) ABSTRACT

Systems and methods are described for the visualization of vehicular-based telematics data. In various aspects, telematics data may be aggregated for a plurality of vehicles where the telematics data can include telematics data observation(s) for each vehicle. Each observation can indicate a coordinate value of the vehicle and a timestamp for the observation, and can further indicate any of a device identifier for a telematics device associated with the vehicle, a speed value of the vehicle, a g-force value of the vehicle, a trip identifier associated with the vehicle, a distance value of the vehicle, or a stop indicator value of the vehicle. A visualization may also be generated based on at least a subset of the telematics data such that the visualization can indicate one or more image features associated with the one or more of the plurality of vehicles.

20 Claims, 10 Drawing Sheets

(56) References Cited

U.S. PATENT DOCUMENTS

| | | | | |
|---|---|---|---|---|
| 2015/0193994 | A1* | 7/2015 | McQuade | G07C 5/0825 701/29.3 |
| 2015/0294422 | A1* | 10/2015 | Carver | G06Q 40/08 705/4 |
| 2016/0075232 | A1* | 3/2016 | Wehrman | B60K 35/00 701/1 |
| 2016/0086397 | A1* | 3/2016 | Phillips | G07C 5/0808 701/32.4 |
| 2017/0021764 | A1* | 1/2017 | Adams | B60Q 9/00 |
| 2017/0123782 | A1* | 5/2017 | Choi | G06F 8/65 |
| 2017/0124660 | A1* | 5/2017 | Srivastava | G06Q 40/08 |
| 2018/0215344 | A1* | 8/2018 | Santora | B60R 25/102 |
| 2018/0268622 | A1* | 9/2018 | MacNeille | G07C 5/008 |
| 2018/0293446 | A1* | 10/2018 | Becker | G06K 9/00791 |

* cited by examiner (Cluster-based Visualization)

(Extreme Driving Visualization)

(Choropleth Map-based Visualization)

650

| COUNTY | AVERAGE_SPEED |
|---|---|
| OHIO, FRANKLIN | 33.51234 |
| OHIO, CUYAHOGA | 32.93163 |
| OHIO, HAMILTON | 32.07051 |
| OHIO, MONTGOMERY | 33.78379 |
| OHIO, SUMMIT | 36.06088 |
| OHIO, LUCAS | 31.46551 |
| OHIO, BUTLER | 30.83996 |
| OHIO, LORAIN | 36.28480 |
| OHIO, MEDINA | 35.98917 |
| OHIO, STARK | 30.99072 |
| OHIO, RICHLAND | 36.29840 |
| OHIO, GREENE | 36.77964 |
| OHIO, DELAWARE | 37.82369 |
| OHIO, WARREN | 37.75153 |
| OHIO, LAKE | 33.68303 |
| OHIO, MAHONING | 35.21327 |
| OHIO, WOOD | 41.41451 |
| OHIO, CLARK | 43.44835 |
| OHIO, TRUMBULL | 37.96558 |
| OHIO, LICKING | 37.00266 |
| OHIO, ROSS | 37.57991 |
| OHIO, CLERMONT | 34.76027 |
| OHIO, PORTAGE | 36.51396 |
| OHIO, ALLEN | 33.74526 |
| OHIO, FAIRFIELD | 34.74428 |
| OHIO, HANCOCK | 37.05989 |
| OHIO, ERIE | 38.04747 |

FIG. 6B

(Heat Map Visualization)

(Heat Table Visualization)

(Trip Path Visualization)

SYSTEMS AND METHODS FOR VISUALIZING TELEMATICS DATA

FIELD OF THE DISCLOSURE

The present disclosure generally relates to visualizing telematics data, and, more particularly, to using the visualizations in various applications.

BACKGROUND

Conventional telematics devices and systems may collect certain types of data regarding vehicle operation. However, conventional telematics devices and data gathering techniques may have several drawbacks. Specifically, conventional telematics devices monitor the movement and operating status of the vehicle in which they are disposed. Such data can include vehicle location, whether the vehicle has been in an accident, or similar simple information regarding the vehicle.

The collection of telematics data for a large number of vehicles and related drivers can create issues regarding how to draw meaningful conclusions from the data, because each vehicle or driver may have its own record or set of associated telemetric data records, and each record can include thousands of data points such as the speed or location of the vehicle at a particular time, such as every second for a given time period, such as over a day, week, or month. Existing systems that track telematics data for a large volume of vehicles may not only have performance issues in analyzing the large sets of telematics data but may also have the inability to provide meaningful representations of the data for use in a variety of applications.

BRIEF SUMMARY

Accordingly, a need exists for systems and methods for analyzing or visualizing large volumes of telematics data to draw meaningful conclusions. In various embodiments herein, systems and methods are described for analyzing large quantities of telematics data using big data techniques, for example, where extremely large data sets are analyzed computationally to reveal patterns, trends, and associations of behaviors related to vehicles or operation of the vehicles. The telematics data could include driving-related data collected from onboard sensors or cameras, or otherwise stored for a vehicle or a driver, for example, data including a unique identifier for the car (e.g., VIN number), the type of car, driver information, a device identifier for the telematics device. The telematics data may further include a speed value, a coordinate value (e.g., indicating the longitude and latitude of the vehicle), a g-force value, a trip identifier value (e.g., identifying a specific trip taken by the vehicle), a distance value (e.g., the number of miles traveled by the vehicle), a stop indicator value (e.g., indicating whether the vehicle was in a stop state or whether the vehicle was first stopped at a particular time), and a timestamp indicating when the aforementioned telematics data was observed.

In various embodiments, the telematics data may be analyzed and display a large quantity of information in a simplified and/or organized manner. In other embodiments, the telematics data may be tagged according to time, geolocation, etc. and then plotted on a map, chart or other visualization so that driving-related trends for an individual driver or driver population can be identified with visual ease.

In various embodiments, systems and methods are described for visualization of vehicular-based telematics data. Imaging-based systems and methods can be processor-implemented to aggregate telematics data for a plurality of vehicles, where the telematics data can include telematics data observation(s) for each vehicle. In some embodiments, each observation can indicate a coordinate value of the vehicle and a timestamp for the observation. In other embodiments, the telematics data can further indicate any of a device identifier for a telematics device associated with the vehicle, a speed value of the vehicle, a g-force value of the vehicle, a trip identifier associated with the vehicle, a distance value of the vehicle, or a stop indicator value of the vehicle. The imaging systems and methods may also generate a visualization based on at least a subset of the telematics data such that the visualization can indicate one or more image features associated with one or more of the plurality of vehicles. The image features can be determined from the one or more observations from the subset of telematics data. For example, in one embodiment, one type of visualization can include a cluster-based visualization, where the image features can include a stops-per-mile value, a move-time-percentage value, or a city-miles-per-total-miles value.

In some embodiments, the imaging systems and methods may include a graphical display, where the imaging systems or methods can render a visualization on the graphical display. In other embodiments the visualization can correspond to a particular vehicle, where the particular vehicle is owned or is otherwise associated with one or more drivers. The visualization can be transmitted to the one or more drivers for a variety of applications as described herein.

In other embodiments, an imaging system can determine a risk profile using one or more the visualizations and/or related telematics data, wherein the risk profile corresponds to a particular vehicle and the particular vehicle corresponds to one or more drivers associated with the vehicle. In one aspect, the risk profile can be used to underwrite, adjust or otherwise determine an insurance premium, policy, discount, or other aspect of the related driver(s)' insurance policy.

The telematics data can be used to generate various types of visualizations, including, for example, an extreme driving visualization, where the extreme driving visualization is operable to identify one or more extreme driving events (e.g., hard braking events or speeding events) that occurred at one or more corresponding locations. The extreme driving visualization may be transmitted to a municipality associated with the one or more corresponding locations in order for the municipality to correct, enforce or otherwise prevent the extreme driving events. Other types of visualizations that may be generated and used in the variety of applications, as described herein, are any of a choropleth map-based visualization, a heat map visualization, a heat table visualization, or a trip path visualization.

Advantages will become more apparent to those of ordinary skill in the art from the following description of the preferred embodiments which have been shown and described by way of illustration. As will be realized, the present embodiments may be capable of other and different embodiments, and their details are capable of modification in various respects. Accordingly, the drawings and description are to be regarded as illustrative in nature and not as restrictive.

BRIEF DESCRIPTION OF THE DRAWINGS

The Figures described below depict various aspects of the system and methods disclosed therein. It should be understood that each Figure depicts an embodiment of a particular aspect of the disclosed system and methods, and that each of the Figures is intended to accord with a possible embodiment thereof. Further, wherever possible, the following description refers to the reference numerals included in the following Figures, in which features depicted in multiple Figures are designated with consistent reference numerals.

There are shown in the drawings arrangements which are presently discussed, it being understood, however, that the present embodiments are not limited to the precise arrangements and instrumentalities shown, wherein:

FIG. 6B illustrates exemplary table depicting telematics data associated with FIG. 6A.

The Figures depict preferred embodiments for purposes of illustration only. Alternative embodiments of the systems and methods illustrated herein may be employed without departing from the principles of the invention described herein.

DETAILED DESCRIPTION

Figure 1:
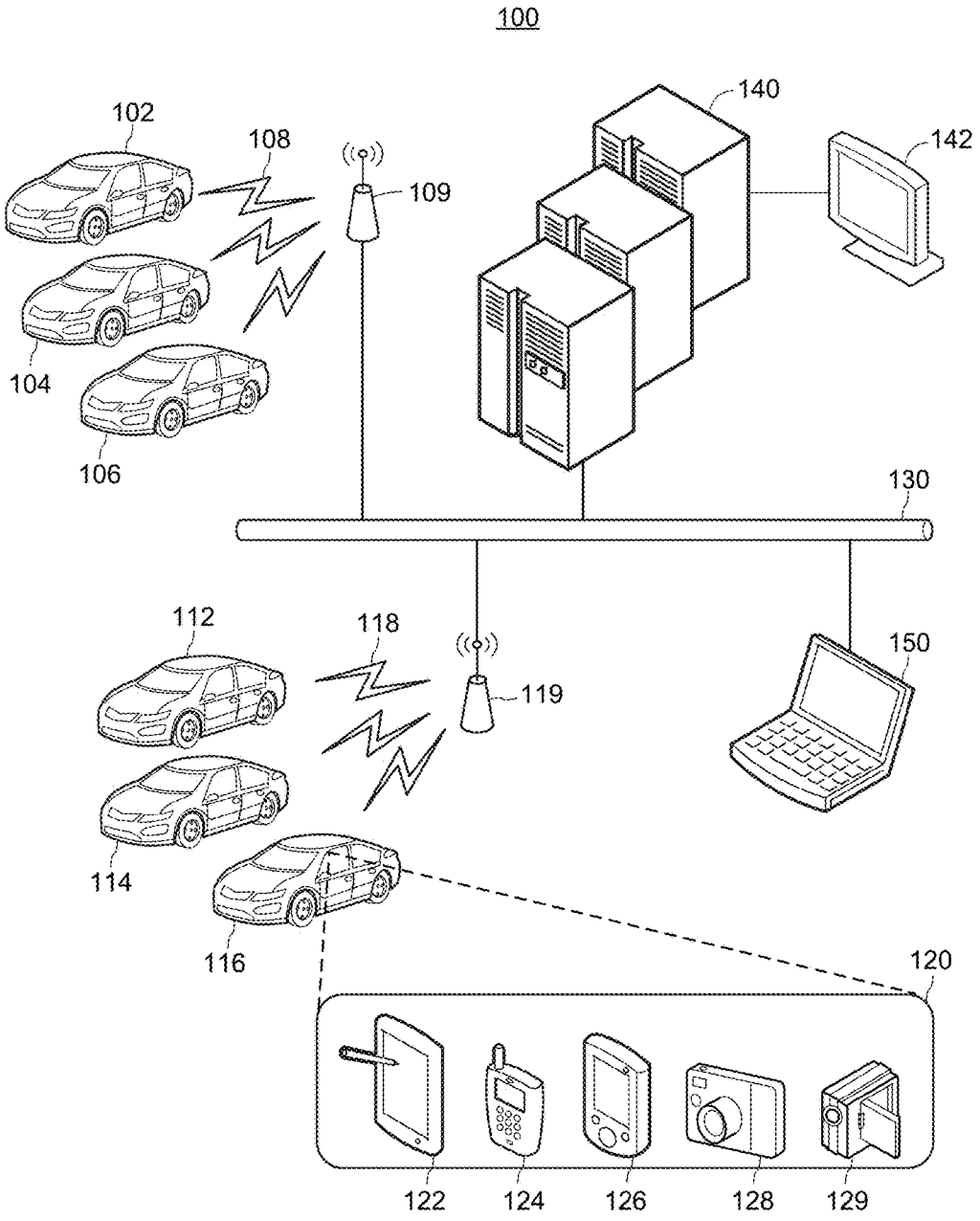
FIG. 1 illustrates a network diagram depicting an exemplary imaging-based system for aggregating and visualizing vehicular-based telematics data.

As described herein, various embodiments relate to, inter alia, imaging systems and methods for visualizing vehicular-based telematics data. FIG. 1 illustrates a network diagram depicting an exemplary imaging-based system 100 for aggregating and visualizing vehicular-based telematics data. In system 100, a plurality of vehicles, for example, vehicles 102, 104, and 106 may wirelessly transmit (108) telematics data to a wireless station 109. The wireless station may be a cellular tower or mobile station implementing any number of telecommunication protocols or standards, including those developed by the 3$^{rd}$ Generation Partnership Project (3GPP), including, such wireless protocols and standards such as GSM, 2G, GPRS, EDGE, UMTS, G3, LTE, and 4G. Although mobile device and cellular based systems are described, it is contemplated that other wireless data transmission protocols and standards may also be used, including 802.11 (WiFi) or Bluetooth® wireless transmission technology.

Imaging-based system 100 further depicts vehicles 112, 114, and 116 in wireless communication (118) with wireless station 119. The wireless transmission between vehicles 112-116 and wireless station 119 may be the same or different from that of vehicles 102-106 and wireless station 109, for example, by use of different wireless protocols or standards.

Vehicles 102-106 and 112-116 may each have sensors, cameras, or other digital measurement devices for collecting telematics data. The telematics data may be captured or generated via electronic or telematics devices onboard or traveling with the vehicles. The devices may generate 2D or 3D imagery or may capture telematics data using a variety of medium, including infrared, temperature or laser. The vehicle telematics devices may be part of the vehicle, such as installed within or on the exterior of the vehicle, as part of the vehicle's manufactured components or may be installed as an aftermarket component. In addition, the telematics devices may also be mobile devices traveling with the vehicles, including, for example, a driver's mobile phone or other mobile device. The telematics devices are operable to of communicate with the wireless stations (e.g., 109 or 119) either on their own, or using transmission components of the vehicles, for example, such as a transceiver installed as part of a vehicle and communicatively coupled to the telematics device of the vehicle.

For example, vehicle 116 may be associated with any of telematics devices 120, which include a tablet device 122, a cellular phone 124, smart phone 126, camera 128, or video camera 129. Vehicle 116 may also include telematics devices, including sensors or cameras, mounted within its interior or exterior (not shown). Any of the telematics devices, either alone or using transceiver equipment associated with the vehicle 116, may capture and transmit (118) telematics data to wireless station 119. The wireless station may be in communication with other networked devices via communication network 130. Communication network 130 can include private or public computer networks, including, for example, the Internet and may use a various of data transmission protocols, including Internet Protocol (IP) and Transmission Control Protocol (TCP) to send and receive the telematics data.

The telematics data may be sent to one or more servers, for example, a remote server. For example, servers 140 may receive or store the telematics data transmitted by any of the telematics devices 120 of vehicle 116. In addition, servers 140 may also receive telematics data from any one of the plurality of vehicles of FIG. 1, including vehicles 102-106 and vehicles 112-116. In this way, the telematics data for a plurality of vehicles may be aggregated for visualization as described herein. The telematics data may be stored for later processing or processed in real-time as vehicles transmit the data. The telematics data may be accessed locally at the servers 140 by, for example, local client system 142. In addition, the telematics data may be accessed remotely, including, for example, by remote client system 150 across communication network 130.

The telematics data can include various types of data collected from the various types of telematics devices, including, for example, telematics devices 120 for vehicle 116. The telematics data may include observations for the type of vehicle, speed, longitude, latitude, g-force, etc. at or over specific times, including, every second or minute of time. In some embodiments, the telematics data may be averaged or otherwise statistically manipulated to capture means, medians, modes or other relations in the data for visualization purposes. Specific examples of telematics data are shown in Table 1:

TABLE 1

| Name | Description |
|---|---|
| trip_number | A trip identifier that identifies a particular trip, such as a trip from a first coordinate value to a second coordinate value, associated with a particular vehicle. |
| device_id | A device identifier that identifies a particular telematics device that captured or generated the telematics data. |
| timestamp | A timestamp (e.g., date, hour, minute, second, millisecond, etc.) associated with an observation of telematics data. The timestamp may be specific to a local time zone or to a universal time zone (e.g., the Greenwich Mean Time (GMT)). |
| latitude | A latitude coordinate reading of a vehicle or mean latitude coordinate reading of a vehicle at or over a particular time. |
| longitude | A longitude coordinate reading of a vehicle or mean longitude coordinate reading of a vehicle at or over a particular time. |
| stop_ind | A value indicating whether a vehicle was stopped at or over a particular time. |
| stop_grp_cnt | A value indicating whether a particular second of time is the first second in a unique stop associated with the vehicle. |
| latG | A G-force value on the vehicle in the lateral (e.g., right-left) directions at or over a particular time. |
| lonG | A G-force on the car in the longitudinal (e.g., forward-backward) directions at or over a particular time. |
| speed | The speed of the vehicle at or over a particular time. |
| inc_mileage | How far the car traveled at or over a particular time. |

Other telematics data may include a city or geographic location associated with the coordinate values, such as the latitude and longitude of the vehicles position. Such geographic information may be collected via a telematics device that has GPS capabilities.

The telematics data may be stored and arranged in a variety of formats and organized, for example, for use with a particular type of visualization. For example, the data may be organized based on the coordinates values indicating where it was captured and then organized by creating rows or tuple values stored in a database at servers 140. The data may be further grouped or clustered, for example, the telematics data captured by vehicles traveling at specific coordinate values may be clustered into groups based on county. In such an embodiment, for example, any telematics data with longitude and latitude coordinates that fall within the county could be part of the cluster for that county and, thus, organized or searched within the database with other telematics data captured for coordinate values that fall within that same county.

Figure 2:
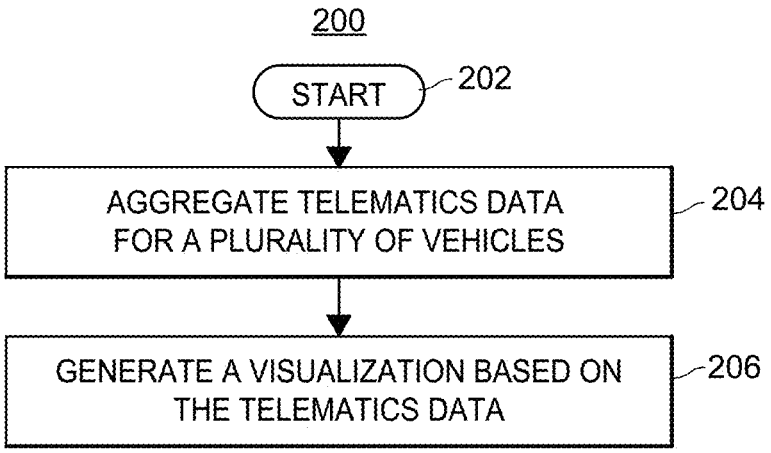
FIG. 2 illustrates a flow diagram of an exemplary method for visualizing vehicular-based telematics data.

FIG. 2 illustrates a flow diagram of an exemplary method 200 for visualizing vehicular-based telematics data. The method 200 may be used, for example, with telematics data stored or received (e.g., in real-time) by servers 140 and as described for FIG. 1.

Method 200 begins (block 202) where the telematics data is aggregated (block 204) for a plurality of vehicles. The telematics data may be aggregated for any number of vehicles, such as vehicles 102-106 and vehicles 112-116. In some embodiments, several thousands or millions of telematics data observations may be collected for the plurality of vehicles. Each observation of data may be for a particular period of time (e.g., every second), as described for FIG. 1. Moreover, each vehicle may be associated with its own set of observations (which can number in the thousands, etc.) and can be identified based on trip id, device id, vehicle type, coordinate values (e.g., longitude and latitude) for a given time as indicated by a timestamp.

At block 206, the imaging system may use the aggregated telematics data, for example, in some embodiments, as part of a big data application, to generate a visualization based on at least a subset of the telematics data. In some embodiments, the subset of data may be any portion of the telematics data, for example, either all or some of the telematics data stored in servers 140, where the subset of data is used to create visualizations of any group of vehicles (or single vehicle) and for any granularity of data. For example, as described herein, a heat map for a particular geographic location may indicate speeding or other unsafe traffic events, where the heat map is based on the telematics data from a plurality of vehicles in the specific geographic location based on the coordinate values of the telematics data, e.g., stored in a database shared by servers 140.

As described herein, each generated visualization can include image feature(s) associated with observations of telematics data collected from the vehicle(s). For example, in some embodiments, as shown for FIG. 4, the image features can include statistical computations of the collected telematics data to produce image feature values descriptive of vehicle or driver behavior, such as stops-per-mile, move-time-percentage, and city-miles-per-total-miles. Other image features may be graphical in nature such as the extreme driving events as indicated by the map-based visualizations of FIGS. 5A-5C.

The visualizations can include a number of different types, including a choropleth map-based visualization (e.g., that shows data values by county), a cluster-based visualization, an animated visualization that shows the trip path of an actual vehicle trip, a visualization indicating where extreme driving events (e.g., hard braking or speeding) occur, a heat map-based visualization (e.g., overlaid on a road map) and a heat table-based visualization (e.g., detailing data by weekday/hour). The visualization types can also include a dashboard-based visualization, which can shows trip data in real time (e.g., including the longitude and latitude coordinate values of the vehicle), the GPS speed of the vehicle at a given time, speed over time, acceleration and braking over time, turning over time, or the latitudinal or longitudinal G-force values over time. The visualizations of the data may be generated via a number of tools, for example, programming languages and packages including R, Python, JavaScript, and SAS JMP and their related graphic and visualization features.

Figure 3:
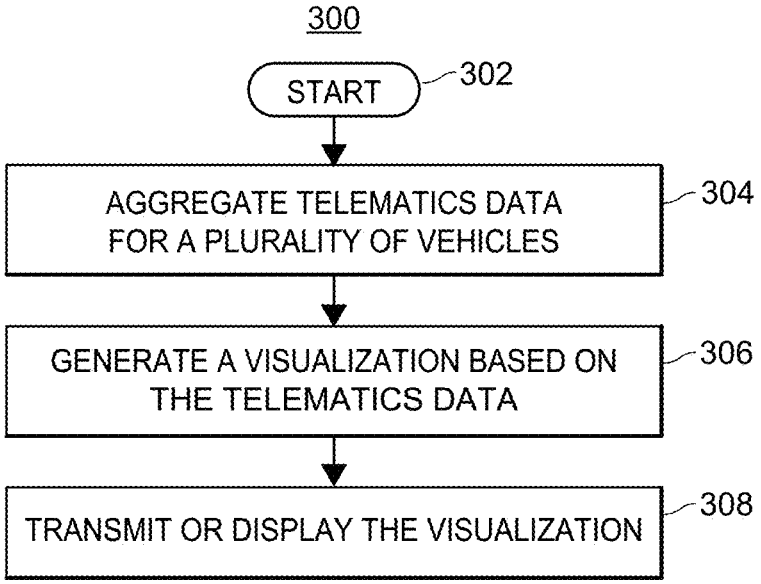
FIG. 3 illustrates a flow diagram of an exemplary method for visualizing and transmitting or displaying vehicular-based telematics data.

FIG. 3 illustrates a flow diagram of an exemplary method 300 for visualizing and transmitting or displaying vehicular-based telematics data. Blocks 302, 304, and 306 correspond to blocks 202, 204, and 206 of FIG. 2, and therefore, the description for each of blocks 202, 204, and 206 correspond to blocks 302, 304, and 306. In addition, at block 308 the visualization, and/or related data associated with the visualization, may be displayed or transmitted in a variety of embodiments and for a variety of applications as described herein. For example, in one embodiment, the an imaging based system may include a graphical display, such as associated with the client devices 142 or 150, for rendering the visualization.

In other embodiments, the visualization (and/or data related thereto) may correspond to a particular vehicle, such as vehicle 116 of FIG. 1. The vehicle 116 may be owned or otherwise associated with one or more drivers. A visualization, such as those described herein, may be and transmitted to the driver(s) of vehicle 116 for inspection or for other notice or information purposes. For example, in some embodiments, a heat map visualization associated a with a driver for the vehicle (e.g., vehicle 116) may be sent to the driver for inspection. For example, the driver may be a customer of an insurance provider, where a customer ID could be used to identify, or is otherwise associated with, the driver's insurance policy with the insurance provider. For example, servers 140 could be associated with an insurance provider that aggregates the telematics data and generates the visualizations for the various embodiments and applications described herein. In one embodiment, a heat map visualization may be sent to a parent for monitoring the driving behavior of a child driver. For example, a heat map could show the child's driving behavior (e.g., speeding) in certain geographic locations or GPS coordinate values. Accordingly, the heat map could be used as a means for the parent to monitor or correct a child's driving patterns associated with a family or other vehicle In another embodiment, the visualization may be sent to a customer or driver as a warning or other indicator, such as a quarterly statement or summary of the customer's or driver's driving behavior. The warning could include, for example, a warning indicating an increase (or possible increase) in an insurance premium based on features detected in the image, such as speeding or hard breaking. In some embodiments, a summary or statement can be provided to the customer or driver indicating a score, a risk profile, or other information related to the visualization, and/or related data, indicating the driver's or customer's driving behavior or patterns.

In various embodiments, the visualization, and/or related telematics data or image feature(s), may be used by an insurance provider to determine insurance premiums, rates, discounts, points, programs, etc., for a driver such as by adjusting an insurance discount or premium based upon the driver or customer behavior. For example, in one embodiment, an imaging system may be configured to determine a risk profile using the visualization, where the risk profile corresponds to a particular vehicle and where the particular vehicle corresponds to one or more drivers associated with the vehicle. In some embodiments, the updated insurance policies (and/or premiums, rates, discounts, etc.) and/or risk profile can be communicated to insurance customers for their review, modification, and/or approval—such as via wireless communication or data transmission from a remote server, such as servers 140, to a device of the driver, such as smartphone 126.

Figure 4:
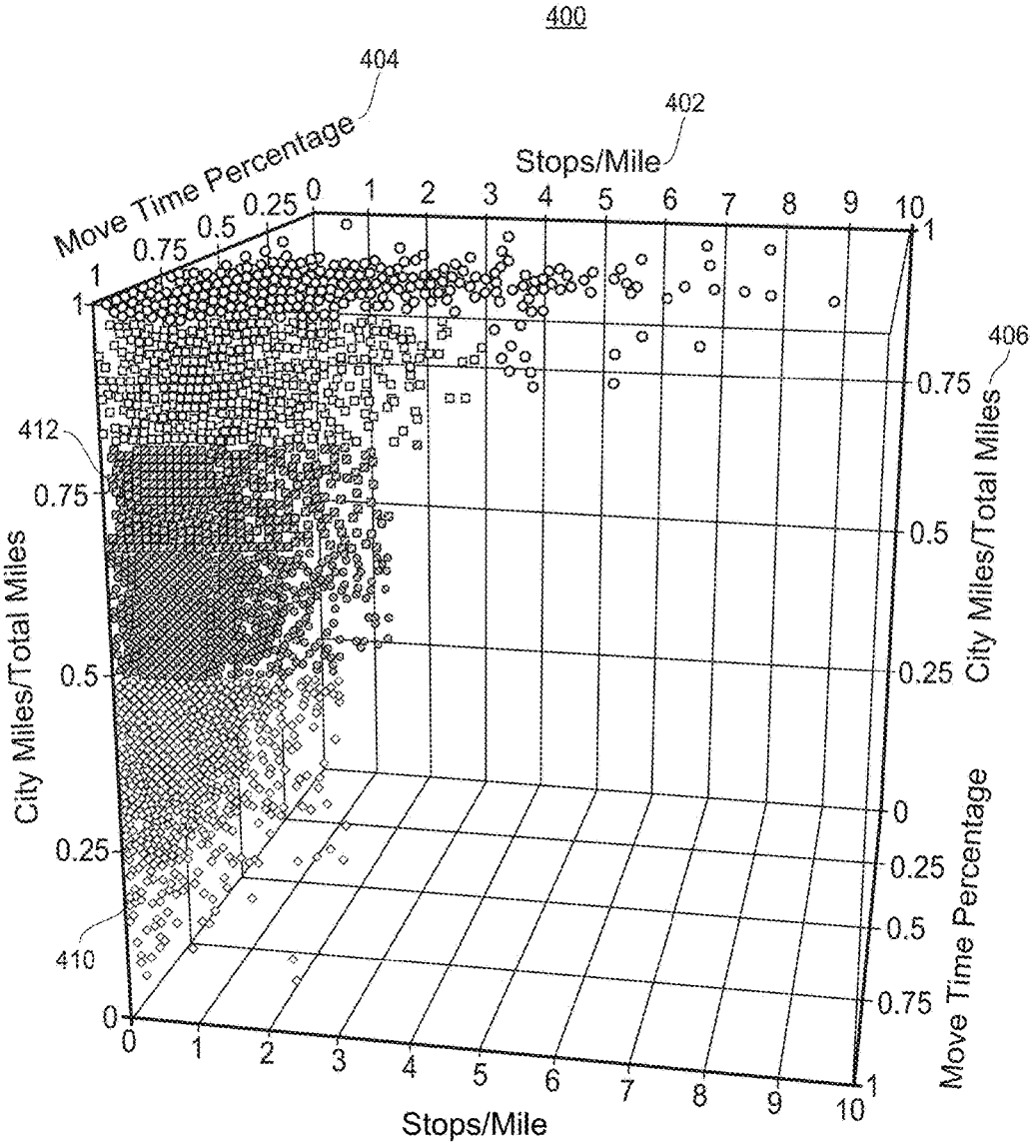
FIG. 4 illustrates an exemplary embodiment of a cluster-based visualization.

FIG. 4 illustrates an exemplary embodiment of a cluster-based visualization 400. In general, a cluster-based visualization can represent a grouping of telematics data or image features that that belongs to the same class. Accordingly, similar telematics data or image features can be grouped into one cluster and dissimilar telematics data or image features can be grouped into another cluster. In FIG. 4, image features, including values for stops-per-mile (402), a move-time-percentage (404), and a city-miles-per-total-miles (406), have been computed from underlying telematics data, such as the telematics data aggregated in servers 140 of FIG. 1. FIG. 4 is represented as a three dimensional visualization having each of the image features (402-406) on a particular axis. Each point in cluster-based visualization 400 represents an observation of telematics data, for example, telematics data stored in servers 140.

In the cluster-based visualization 400, the observations are clustered according to the image features (402-406), giving a macro level view the telematics data with respect to stops-per-mile (402), move-time-percentage (404), and city-miles-per-total-miles (406). For example, a particular cluster 412 shows telematics data in a particular shade or color to indicate a group telematics data associated with a higher city-miles-per-total-miles (406) value and a higher stops-per-mile value (402) (the first cluster 412, being at around 0.75 with respect to image feature 406), than for a different cluster 410 that shows telematics data in a different shade or color to indicate a group telematics data associated with a lower city miles city-miles-per-total-miles (406) value and a lower stops-per-mile value (402) (the second cluster 410, being at around 0.25 with respect to image feature 406). Accordingly, clusters 412 and 410, when analyzed together, can define a pattern, where, in the example of FIG. 4, an increase in the stops-per-mile (402) indicates a decrease in the city-miles-per-total-miles (406). In one embodiment, the image features and related data of the visualization 400 may be used by an insurance provider to identify certain driving environments (e.g., city vs. rural) and could be used in the determination of customer risk profiles or to identify hazardous areas or locations as described herein.

Figure 5A:
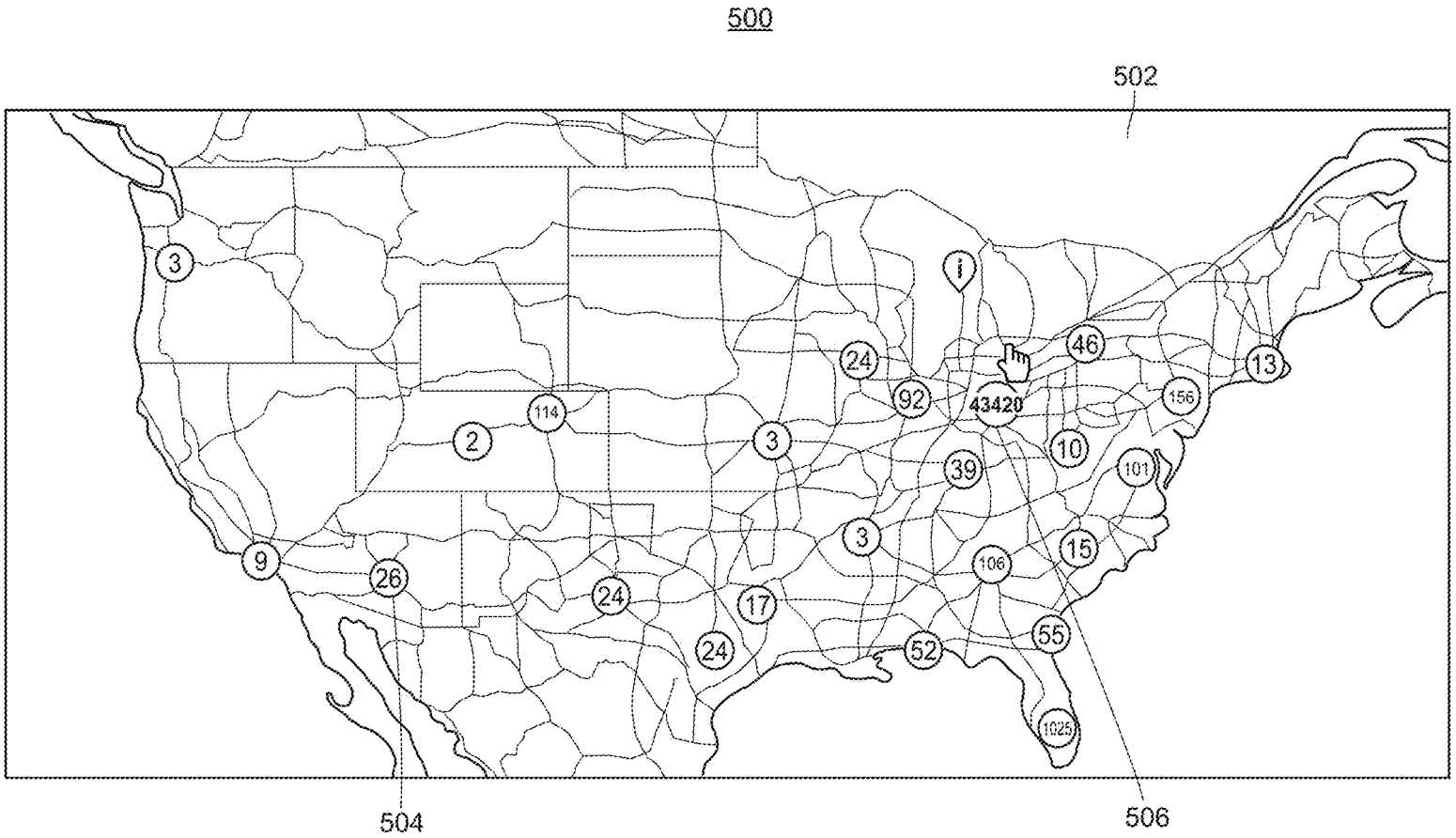
FIG. 5A illustrates an exemplary embodiment of an extreme driving visualization.

FIG. 5A illustrates an exemplary embodiment of an extreme driving visualization 500. The extreme driving visualization 500 is a mapped-based visualization that can be used to visualize or identify extreme driving events, such as hard stops in a certain location or where drivers have been identified as speeding (e.g., greater than 70 mph). The extreme driving events can be determined from the telematics data including, for example, telematics data aggregated at servers 140 of FIG. 1. For example, extreme driving visualization 500 depicts map 502 zoomed at the level depicting the United States. The map 502 can show locations of extreme driving events in clustered groups, for example, extreme driving clusters 504 and 506, which are image features associated with visualization 500. The extreme driving clusters 504 and 506 can represent areas, locations or coordinate values with, e.g., extreme driving events such as hard stopping and speeding. Each extreme driving cluster (image feature) can indicate a number of extreme driving events detected in the location. For example, cluster 504 indicates that 26 extreme driving events occurred at or near an area to the northwest of Tucson, Ariz. Similarly, cluster 506 indicates that 43,420 extreme driving events occurred at or near Columbus, Ohio.

Figure 5B:
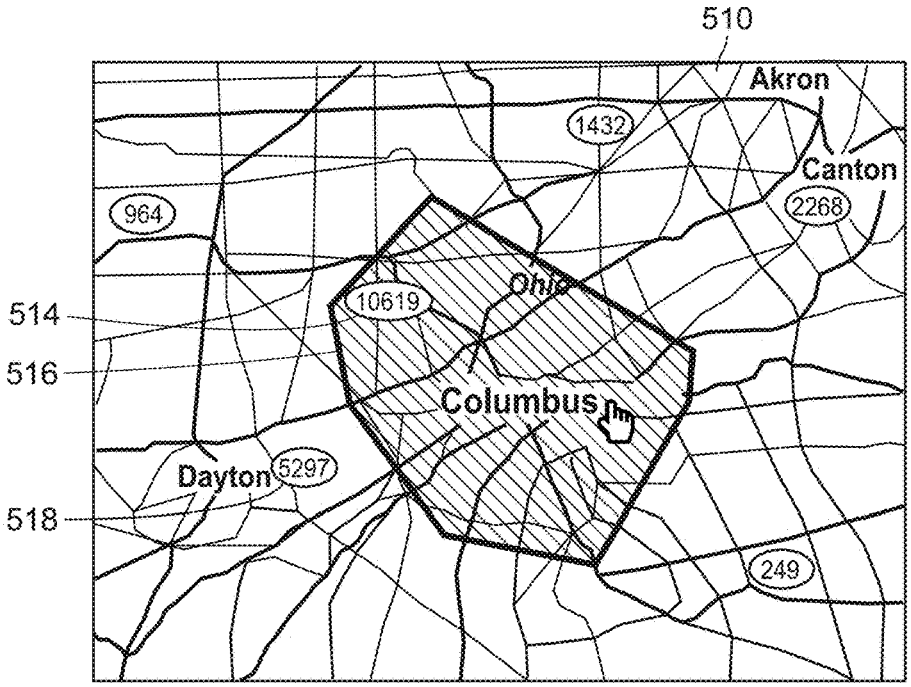
FIG. 5B illustrates an exemplary embodiment of a zoomed in extreme driving visualization of FIG. 5A.

In certain embodiments, the extreme driving visualization 500 can be operable to identify one or more extreme driving events that occurred at one or more corresponding locations. For example, FIG. 5B illustrates an exemplary embodiment of a zoomed in extreme driving visualization 510, where a user has selected cluster 506 at or near Columbus, Ohio. In the embodiment, the visualization 510 shows a zoomed in representation of visualization 500, where the extreme driving events of cluster 506 are broken out into further specific clusters at or near the original cluster 506. For example, the cluster 506 is broken out into several specific clusters, including clusters 514 and clusters 518, indicating more precise locations of occurrence of the extreme driving events, such as northwest of Columbus, Ohio and at or near Dayton, Ohio, for clusters 514 and 518, respectively. By selecting a particular cluster, such as cluster 514, a user can visualize the area defined by the cluster. For example, area 516 defines the cluster 514 such that the 10,619 extreme driving events of cluster 514 occurred within area 516.

Figure 5C:
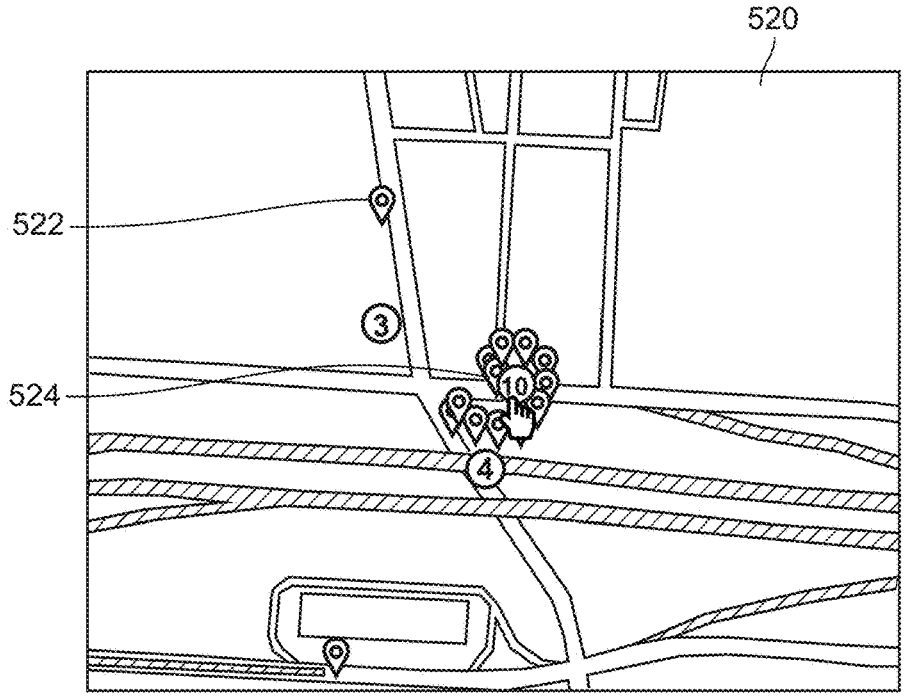
FIG. 5C illustrates an exemplary embodiment of a further zoomed extreme driving visualization of FIG. 5A.

FIG. 5C shows a further zoomed visualization 520, that may be depicted when a user selects more specific image features, such as clusters 514 or 518. For example, FIG. 5C shows a zoomed in portion of visualization 510 when a user selects cluster 514 of FIG. 5B. In addition to depicting even more specific clusters, FIG. 5C shows additional image features, such as indications of the actual location or coordinates of the occurrence of an extreme driving event. For example, image feature 522 can indicate an extreme driving location of where a speeding event occurred. In certain embodiments, a user hovering a mouse, selecting or otherwise requesting more information for image feature 522 can determine more information about the speeding event, such as how fast a driver was going at the image feature location 522. The clusters of FIG. 5C, such as cluster 524, can be selected to show additional image features detailing the specific extreme events that occurred at that particular location. For example, cluster 524 indicates that ten extreme driving events occurred at the location indicated by cluster 524. Each of the extreme driving events are indicated by its own image feature (as shown by the information ("i") points) surrounding cluster 524 on the visualization 520. As a group, the extreme driving events of cluster 524 can indicate particular locations, such as intersections, roadways, or stops that are more hazardous or dangerous on average, for example, because of vehicular hard braking events (determined from accelerometer or telemetric data determined from the telemetric devices of FIG. 1) or because of speeding.

In certain embodiments any one or more of the visualizations, 500, 510, or 520, may be transmitted to a municipality associated with the one or more corresponding locations or coordinate values of the extreme driving events. The transmission may be used to inform local municipality of traffic hazards, e.g., hard stops in a certain location or where customers have been identified as speeding (e.g., greater than 70 mph). The municipality may then use the data to determine what intersections, locations or otherwise areas to improve or otherwise provide increased enforcement or policing in order to better provide its citizens with improved safety.

Figure 6A:
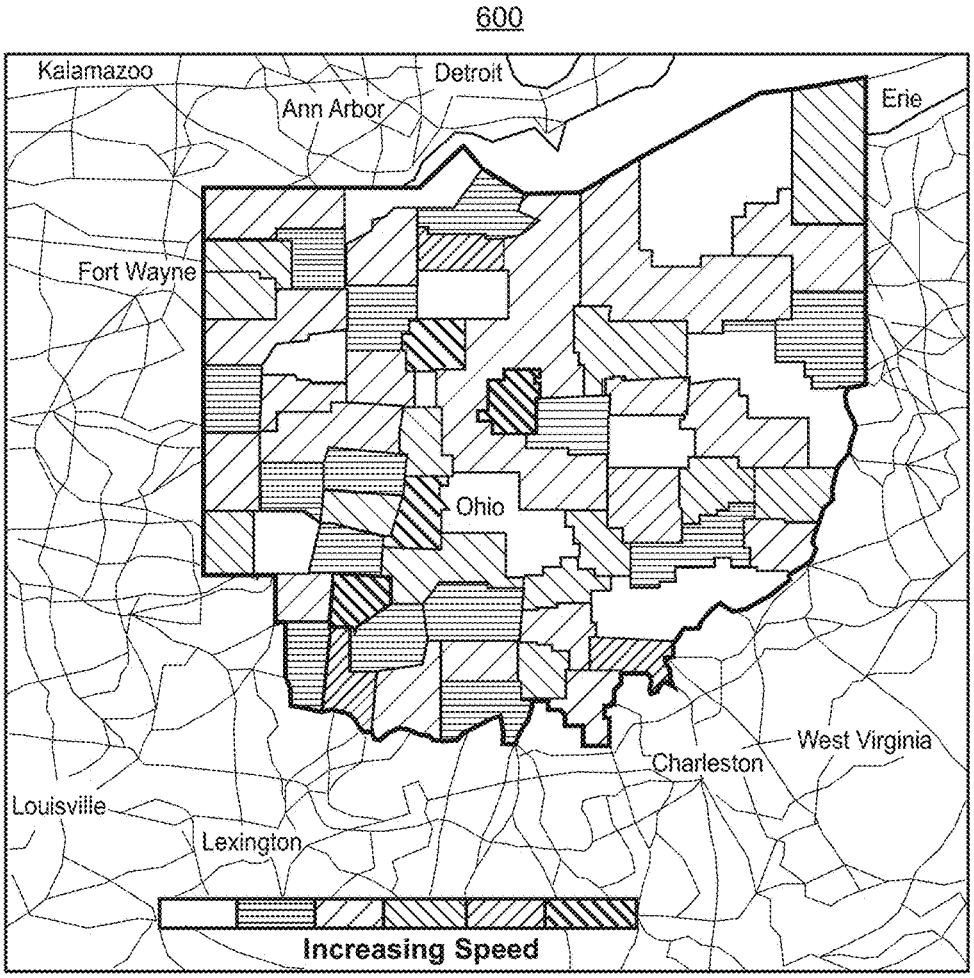
FIG. 6A illustrates an exemplary embodiment of a choropleth map-based visualization.

FIG. 6A illustrates an exemplary embodiment of a choropleth map-based visualization 600. A choropleth visualization can display divided geographical areas or regions that may be colored, shaded or patterned in relation to the telematics data as described herein. Accordingly, a choropleth visualization can be used to visualize values over a geographical area, which can show variation or patterns across the displayed location. FIG. 6A shows an example choropleth map-based visualization 600 depicting various counties in the state of Ohio. Each of the counties are image features that are shaded, patterned, or colored based on telematics data collected and aggregated in each respective county. In the embodiment of FIG. 6A, the counties are shaded, patterned or colored in relation to the average speed of vehicles in those counties, where the average speed is determined from the telematics data, such as the aggregated telematics data of servers 140 described for FIG. 1. In FIG. 6A the darker shaded or patterned counties indicate counties having an increased average speed than lighter shaded, patterned or blank counties.

FIG. 6B illustrates exemplary table 650 depicting telematics data associated with FIG. 6A. Table 650 could be, for example, a subset of the telematics data aggregated in a database associated with the servers 140 of FIG. 1. Table 650 shows telematics data used for the visualization 600 grouped by county, and including the average speed computed by averaging the speed telematics data captured (e.g., by the telematics devices of FIG. 1) for each respective county. Accordingly, the telematics data of table 650 can be used to generate visualization 600 and can be further used for other applications, including for example, to adjust insurance premiums, policies, discounts, etc. for insurance customers based on where county the customer resides. For example, counties with higher average speeds could be determined as more risky than counties with lower average speeds, and thus an insurance premium, policy, etc. for an insurance customer in a county with higher average speeds could be adjusted higher than for counties with lower average speeds.

Figure 7:
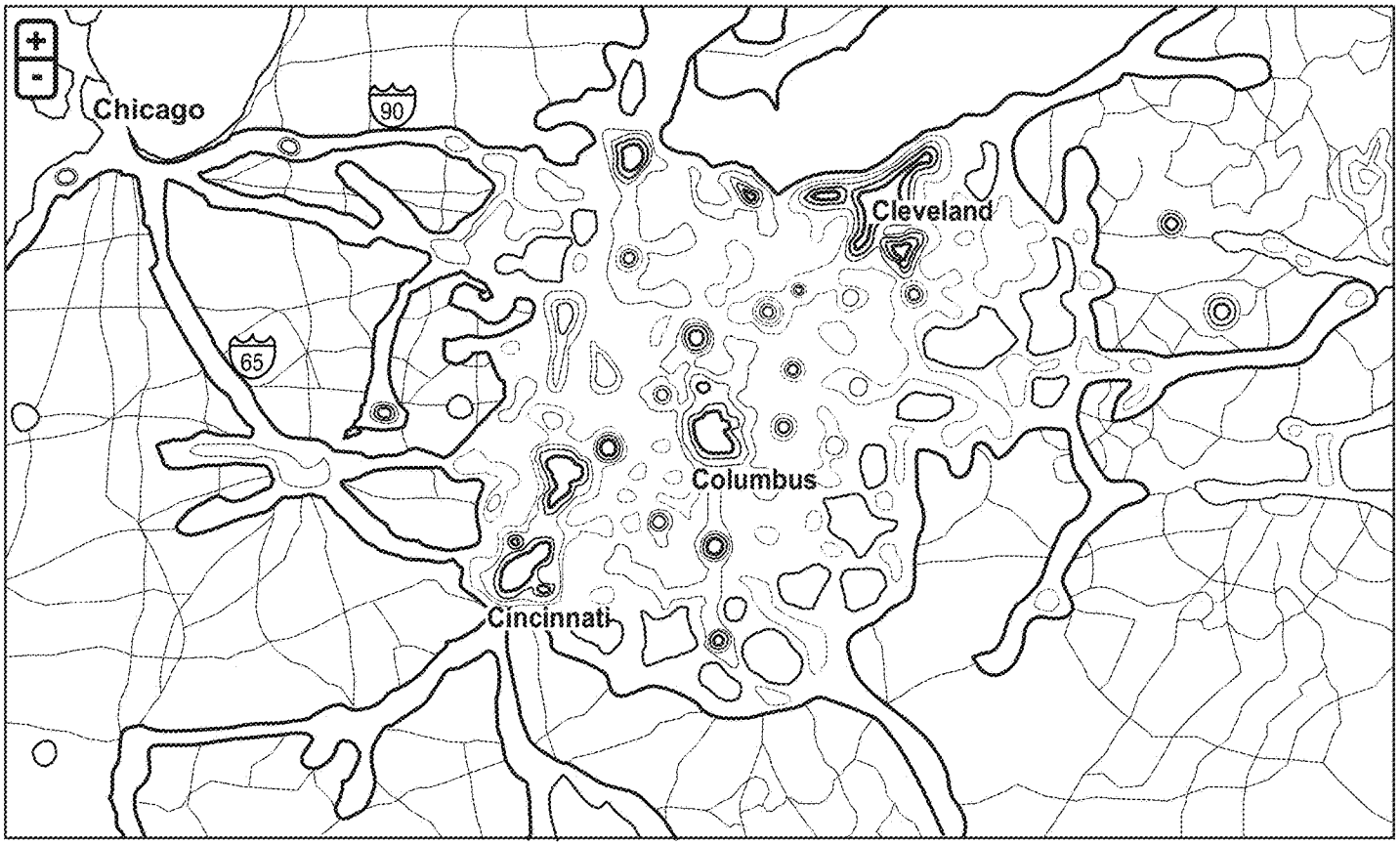
FIG. 7 illustrates an exemplary embodiment of a heat map visualization.

FIG. 7 illustrates an exemplary embodiment of a heat map visualization 700. In the embodiment of FIG. 7, a heat map visualization is overlaid on the state of Ohio. A heat map visualization can indicate, with darker or warmer image features (e.g., such as darker shaded areas for gray-scale image features, red or orange areas for colored image features, or more heavily contoured areas for contoured image features), the locations or coordinate values where most drivers are located or the routes most frequently used by driver(s). In FIG. 7, for example, the "hot" (e.g., darker or red) regions are overlaid on top of the larger cities of Ohio, including Cleveland, Columbus, and Cincinnati, indicating the regions having high quantities of drivers. In addition, FIG. 7 includes coloring, shaded or contoured regions overlaid on top of U.S. Interstates 65 and 90, indicating routes most frequently used by drivers. The image features of the heat map visualization may be used by an insurance provider in determining premiums, rates, discounts, etc. for particular regions where, for example, a region having an increased number of drivers or more frequently driven routes may have higher insurance premiums than for regions with fewer drivers or less frequently driven routes. In addition, a heat map visualization may be generated for an individual driver showing the specific routes typically driven by the driver. The heat map may be transmitted to the driver to inform the driver about the locations where he frequently drives or may be used as a basis to adjust an insurance premium or policy associated with the driver.

Figure 8:
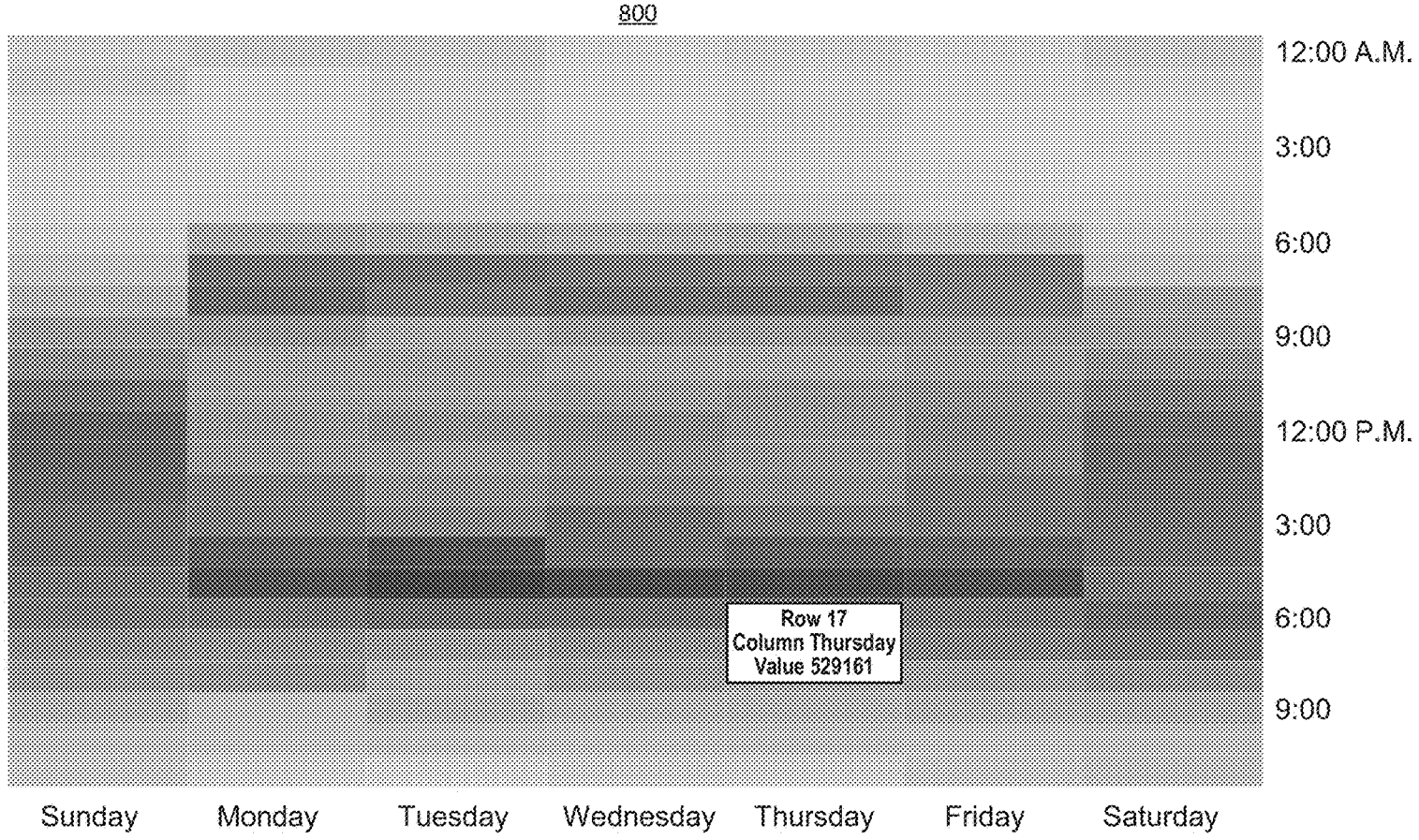
FIG. 8 illustrates an exemplary embodiment of a heat table visualization.

FIG. 8 illustrates an exemplary embodiment of a heat table visualization 800. A heat table visualization can indicate the days and times of increased traffic for a specific area or coordinates, where darker image features indicate increased traffic compared with lighter image features, which indicate less traffic. The specific area or coordinates could correspond, for example, to the extreme driving event locations depicted in FIGS. 5A-5C. The embodiment of FIG. 8 indicates that for the area or coordinates for visualization 800, increased traffic is experienced at the darker image features, which, in visualization 800, are Monday through Friday just before 9:00 am and just before 6:00 pm, indicating typical rush-hour traffic.

Figure 9:
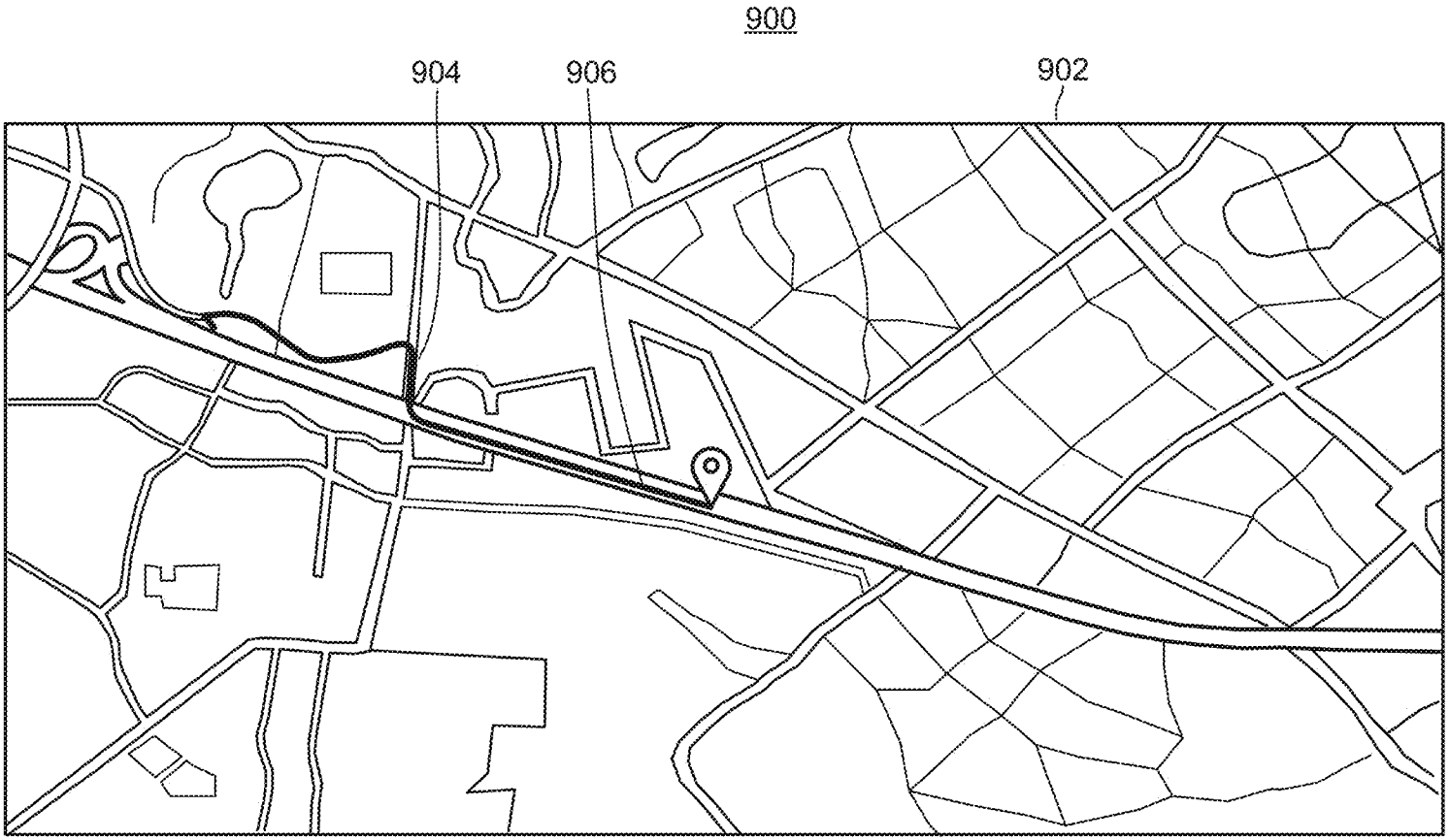
FIG. 9 illustrates an exemplary embodiment of a trip path visualization.

FIG. 9 illustrates an exemplary embodiment of a trip path visualization 900. A trip path visualization uses telematics data of a vehicle to recreate or "play back' a trip for the vehicle, where the trip can begin at a first location and can end at a second location. A trip path visualization can be useful in determining hard stops or speeding events, such as those described for FIGS. 5A-5C. For example, visualization 900 includes a map 902 that indicates the region or area in which a trip for a particular vehicle occurred. Visualization 900 shows a trip path along image features 904 and 906 for the vehicle. Image feature 904 depicts a hard stop event where the vehicle braked suddenly at a traffic light just before entering a highway onramp. Image feature 906 indicates an area where the vehicle was speeding on the highway. In some embodiments, the trip path visualization can be transmitted to a driver of the vehicle as described herein. In other embodiments, the trip path visualization may be used by an insurance provider to adjust or underwrite a policy holder's premium, discount, policy, etc. based on the specific driving events determined from the trip path visualization.

In certain embodiments, the telematics data described for any of the above visualizations may be used to perform additional statistical analysis and/or modeling of the data. In certain embodiments, statistical models could complement the visualizations and be used to identify additional vehicle or driver characteristics or behavior. Statistical methods that may be used to generate the models may include, but are not limited to, GBMs, GAMs, Clustering models, Random Forests, Support Vector Machines, Regression, etc. Using these techniques, the visualizations can be complimented or enhanced to determine additional driving patterns, e.g., driving patterns indicative of vehicular accidents.

Additional Considerations

With the foregoing, an insurance customer may opt-in to a rewards, insurance discount, or other type of program. After the insurance customer provides their permission or affirmative consent, an insurance provider telematics application and/or remote server may collect telematics and/or other data (including image or audio data) associated with insured assets, including before, during, and/or after an insurance-related event or vehicle collision. In return, risk averse drivers, and/or vehicle owners may receive discounts or insurance cost savings related to auto, home, life, and other types of insurance from the insurance provider.

In one aspect, telematics data, and/or other data, including the types of data discussed elsewhere herein, may be collected or received by an insured's mobile device or smart vehicle, a Telematics Application running thereon, and/or an insurance provider remote server, such as via direct or indirect wireless communication or data transmission from a Telematics Application ("App") running on the insured's mobile device or smart vehicle, after the insured or customer affirmatively consents or otherwise opts-in to an insurance discount, reward, or other program. The insurance provider may then analyze the data received with the customer's permission to provide benefits to the customer. As a result, risk averse customers may receive insurance discounts or other insurance cost savings based upon data that reflects low risk driving behavior and/or technology that mitigates or prevents risk to (i) insured assets, such as vehicles or even homes, and/or (ii) vehicle operators or passengers.

Although the disclosure provides several examples in terms of two vehicles, two mobile computing devices, two on-board computers, etc., aspects include any suitable number of mobile computing devices, vehicles, etc. For example, aspects include an external computing device receiving telematics data and/or geographic location data from a large number of mobile computing devices (e.g., 100 or more), and issuing alerts to those mobile computing devices in which the alerts are relevant in accordance with the various techniques described herein.

Although the following text sets forth a detailed description of numerous different embodiments, it should be understood that the legal scope of the description is defined by the words of the claims set forth at the end of this patent and equivalents. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

The following additional considerations apply to the foregoing discussion. Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Additionally, certain embodiments are described herein as including logic or a number of routines, subroutines, applications, or instructions. These may constitute either software (e.g., code embodied on a machine-readable medium or in a transmission signal) or hardware. In hardware, the routines, etc., are tangible units capable of performing certain operations and may be configured or arranged in a certain manner. In example embodiments, one or more computer systems (e.g., a standalone, client or server computer system) or one or more hardware modules of a computer system (e.g., a processor or a group of processors) may be configured by software (e.g., an application or application portion) as a hardware module that operates to perform certain operations as described herein.

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods or routines described herein may be at least partially processor-implemented. For example, at least some of the operations of a method may be performed by one or more processors or processor-implemented hardware modules. The performance of certain of the operations may be distributed among the one or more processors, not only residing within a single machine, but deployed across a number of machines. In some example embodiments, the processor or processors may be located in a single location, while in other embodiments the processors may be distributed across a number of locations.

The performance of certain of the operations may be distributed among the one or more processors, not only residing within a single machine, but deployed across a number of machines. In some example embodiments, the one or more processors or processor-implemented modules may be located in a single geographic location (e.g., within a home environment, an office environment, or a server farm). In other embodiments, the one or more processors or processor-implemented modules may be distributed across a number of geographic locations.

This detailed description is to be construed as exemplary only and does not describe every possible embodiment, as describing every possible embodiment would be impractical, if not impossible. One may be implement numerous alternate embodiments, using either current technology or technology developed after the filing date of this application.

Those of ordinary skill in the art will recognize that a wide variety of modifications, alterations, and combinations can be made with respect to the above described embodiments without departing from the scope of the invention, and that such modifications, alterations, and combinations are to be viewed as being within the ambit of the inventive concept.

The patent claims at the end of this patent application are not intended to be construed under 35 U.S.C. § 112(f) unless traditional means-plus-function language is expressly recited, such as "means for" or "step for" language being explicitly recited in the claim(s). The systems and methods described herein are directed to an improvement to computer functionality, and improve the functioning of conventional computers.

What is claimed is:

1. An imaging system configured to visualize vehicular-based telematics data, the imaging system comprising:

one or more processors, configured to:

aggregate telematics data for a plurality of vehicles, the telematics data including one or more observations for each vehicle, each observation indicating at least a coordinate value of the vehicle and a timestamp for each observation;

generate a visualization based on at least a subset of the telematics data, wherein the subset of the telematics data defines a hazardous driving area, and wherein the visualization indicates one or more image features associated with one or more of the plurality of vehicles at the hazardous driving area, the image features determined from the one or more observations from the subset of telematics data; and determine a risk profile for a new vehicle based on the visualization.

2. The imaging system of claim 1, wherein each observation further indicates one or more of the following: a device identifier for a telematics device associated with the vehicle, a speed value of the vehicle, a g-force value of the vehicle, a trip identifier associated with the vehicle, a distance value of the vehicle, or a stop indicator value of the vehicle.

3. The imaging system of claim 1, wherein the visualization is a cluster-based visualization.

4. The imaging system of claim 3, wherein the one or more image features include a stops-per-mile value, a move-time-percentage value, and a city-miles-per-total-miles value.

5. The imaging system of claim 3, wherein the cluster-based visualization is a three dimensional cluster-based visualization defining a pattern between at least two image features along two respective axes of the three dimensional cluster-based visualization.

6. The imaging system of claim 1, wherein the visualization is an extreme driving visualization, wherein the extreme driving visualization is operable to identify one or more extreme driving events that occurred at one or more corresponding locations.

7. The imaging system of claim 6, wherein the extreme driving visualization is transmitted to a municipality associated with the one or more corresponding locations.

8. The imaging system of claim 1, wherein the visualization is any one of the following: a choropleth map-based visualization, a heat map visualization, a heat table visualization, or a trip path visualization.

9. The imaging system of claim 1, wherein the visualization corresponds to a particular vehicle, the particular vehicle corresponding to one or more drivers associated with the vehicle, and wherein the visualization is transmitted to the one or more drivers.

10. The imaging system of claim 1 further configured to determine a risk profile using the visualization, wherein the risk profile corresponds to a particular vehicle, the particular vehicle corresponding to one or more drivers associated with the vehicle.

11. A computer-implemented imaging method of visualizing vehicular-based telematics data using one or more processors, the imaging method comprising:

aggregating telematics data, using one or more processors, for a plurality of vehicles, the telematics data including one or more observations for each vehicle, each observation indicating at least a coordinate value of the vehicle and a timestamp for each observation;

generating a visualization, using one or more processors, based on at least a subset of the telematics data, wherein the subset of the telematics data defines a hazardous driving area, and wherein the visualization indicates one or more image features associated with one or more of the plurality of vehicles, the image features determined from the one or more observations from the subset of telematics data; and determining a risk profile for a new vehicle based on the visualization.

12. The imaging method of claim 11, wherein each observation further indicates one or more of the following: a device identifier for a telematics device associated with the vehicle, a speed value of the vehicle, a g-force value of the vehicle, a trip identifier associated with the vehicle, a distance value of the vehicle, or a stop indicator value of the vehicle.

13. The imaging method of claim 11, wherein the visualization is a cluster-based visualization.

14. The imaging method of claim 13, wherein the one or more image features include a stops-per-mile value, a move-time-percentage value, and a city-miles-per-total-miles value.

15. The imaging method of claim 13, wherein the cluster-based visualization is a three dimensional cluster-based visualization defining a pattern between at least two image features along two respective axes of the three dimensional cluster-based visualization.

16. The imaging method of claim 11, wherein the visualization is an extreme driving visualization, wherein the extreme driving visualization is operable to identify one or more extreme driving events that occurred at one or more corresponding locations.

17. The imaging method of claim 16, wherein the extreme driving visualization is transmitted to a municipality associated with the one or more corresponding locations.

18. The imaging method of claim 11, wherein the visualization is any one of the following: a choropleth map-based visualization, a heat map visualization, a heat table visualization, or a trip path visualization.

19. The imaging method of claim 11, wherein the visualization corresponds to a particular vehicle, the particular vehicle corresponding to one or more drivers associated with the vehicle, and wherein the visualization is transmitted to the one or more drivers.

20. The imaging method of claim 11 further comprising determining a risk profile using the visualization, wherein the risk profile corresponds to a particular vehicle, the particular vehicle corresponding to one or more drivers associated with the vehicle.

* * * * *